US006410214B1

(12) United States Patent
Kim

(10) Patent No.: US 6,410,214 B1
(45) Date of Patent: Jun. 25, 2002

(54) METHOD FOR MANUFACTURING BLACK MATRIX OF PLASMA DISPLAY PANEL

(75) Inventor: Jeong Jun Kim, Kyungsangbuk-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/406,845

(22) Filed: Sep. 29, 1999

(30) Foreign Application Priority Data

Oct. 1, 1998 (KR) ..... 98/41479

(51) Int. Cl.[7] ..... H01J 17/04

(52) U.S. Cl. ..... 430/321; 430/319; 445/24; 427/68; 427/304; 427/305

(58) Field of Search ..... 430/314, 315, 430/319, 321; 445/24; 427/304, 305, 68; 313/492, 483, 582, 583, 584, 585, 586, 587

(56) References Cited

U.S. PATENT DOCUMENTS 5,185,074 A * 2/1993 Yokoyama et al. ..... 205/162
5,800,952 A * 9/1998 Urano et al. ..... 430/7
5,892,492 A * 4/1999 Osawa et al. ..... 345/60
5,952,282 A * 9/1999 Nanto et al. ..... 313/584
6,208,404 B1 * 3/2001 Tomoyori et al. ..... 349/187

FOREIGN PATENT DOCUMENTS

JP 4-067534 * 3/1992
JP 5-341117 * 12/1993
JP 9304761 11/1997

* cited by examiner

*Primary Examiner*—John A. McPherson
(74) *Attorney, Agent, or Firm*—Fleshner & Kim, LLP

(57) ABSTRACT

A method for manufacturing a black matrix of a plasma display panel includes the steps of forming transparent electrodes of upper electrode patterns and black matrix patterns on an upper substrate, and depositing a predetermined metal material on the transparent electrodes of the black matrix patterns. In the method for manufacturing a black matrix of a plasma display panel, it is possible to manufacture the black matrix without performing a separate baking process. In addition, since it is possible to pattern the upper electrode and the black matrix at the same time, the manufacturing process steps are simplified and the manufacturing cost is saved.

26 Claims, 2 Drawing Sheets

METHOD FOR MANUFACTURING BLACK MATRIX OF PLASMA DISPLAY PANEL

BACKGROUND OF THE INVENTION

1. Field of the Invention

The present invention relates to a method for manufacturing a plasma display panel, and more particularly, to a method for manufacturing a black matrix of a plasma display panel.

2. Background of the Related Art

Generally, a plasma display panel and a liquid crystal display (LCD) have lately attracted considerable attention as the most practical next display of panel displays. In particular, the plasma display panel has higher luminance and wider visible angle than the LCD. For this reason, the plasma display panel is widely used as a thin type large display such as an outdoor advertising tower, a wall TV, and a theater display.

The plasma display panel performs display operation in such a manner to emit a phosphor using ultraviolet rays generated by plasma discharge of inert gas. Such a plasma display panel includes AC plasma display panel having a dielectric film on an electrode surface and DC plasma display panel whose electrode surface is exposed to a discharge space.

FIG. 1 is a sectional view illustrating a general AC plasma display panel of three-electrode area discharge type. As shown in FIG. 1, the plasma display panel includes an upper structure and a lower structure. The upper structure includes an upper electrode 4 having a scan electrode and a sustain electrode on the same plane of a front glass substrate 1, a dielectric layer 2 formed on the upper electrode 4 by printing, and a passivation layer deposited-on the dielectric layer 2. The lower structure includes an address electrode 12 formed on a rear glass substrate 11 of the upper structure to cross the upper electrode 4, an isolation wall 6 formed to prevent crosstalk of cell between the address electrodes 12, and phosphors 8, 9 and 10 formed around the isolation wall 6 and the address electrode 12. The inert gas is sealed in a space between the upper structure and the lower structure. The space is used as a discharge region 5 where plasma discharge occurs. At this time, the inert gas in the discharge region is a penning gas including He as a main component and Xe and Ne as other components at a pressure of about 400~500 torr. FIG. 1 shows the upper substrate rotated by 90° for convenience.

The AC plasma display panel of three-electrode area discharge type generates opposite discharge between the address electrode and the scan electrode if a driving voltage is applied between the address electrode and the scan electrode. As a result, wall charge occurs on a surface of the passivation layer of the upper structure. In this case, since a predetermined potential difference is maintained between Y electrode and Z electrode by wall charge, discharge voltages having opposite polarities are continuously applied to the scan electrode and the sustain electrode even if the driving voltage applied to the address electrode is broken. Thus, area discharge occurs in the discharge area on the surface of the passivation layer 3 and the dielectric layer 2. This area discharge generates ultraviolet rays 7 are generated from the inert gas of the discharge region. The ultraviolet rays 7 comes into collision with the surfaces of the phosphors 8, 9 and 10 to excite the phosphors. The excited phosphors 8, 9 and 10 are emitted to display color.

The principles of generating the ultraviolet rays by discharge are as follows.

If the driving voltage is applied to the scan electrode and the sustain electrode, electrons in the discharge cell are accelerated to negative electrode by the driving voltage. The accelerated electrons come into collision with the inert mixing gas filled in the discharge cell. The inert gas is excited by the collision to generate ultraviolet rays having a wavelength of 147 nm. The ultraviolet rays come into collision with the phosphors 8, 9 and 10 surrounding the lower electrode 12 and the isolation wall 6, so that light of a visible right ray region is emitted.

The plasma display panel has a space of a predetermined interval to reduce interference which occurs between adjacent discharge cells. A black matrix 13 is formed in a region corresponding to the space, as shown in FIG. 2. The region where the black matrix 13 is formed corresponds to the rear of the glass substrate between upper electrodes of the front glass substrate. The black matrix is formed by printing a paste type black matrix material as a predetermined mask. FIG. 2 shows a structure of the upper electrode of FIG. 1 in detail where the upper electrode 4 has bus electrodes 4' thereon.

However, the related art method for manufacturing the black matrix of a plasma display panel has several problems.

Since the black matrix is formed using a separate paste material, the manufacturing cost is expensive and the manufacturing time increases. In particular, since the related art method for manufacturing the black matrix of a plasma display panel includes the step of baking the paste material, the material consumption increases, thereby causing inefficient material use.

SUMMARY OF THE INVENTION

Accordingly, the present invention is directed to a method for manufacturing a black matrix of a plasma display panel that substantially obviates one or more of the problems due to limitations and disadvantages of the related art.

An object of the present invention is to provide a method for manufacturing a black matrix of a plasma display panel, which does not need a separate baking process to save the manufacturing cost.

Another object of the present invention is to provide a method for manufacturing a black matrix of a plasma display panel, in which the black matrix is formed by rear blackening performed by chemical-plating of a metal oxide film.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a method for manufacturing a black matrix of a plasma display panel includes the steps of forming transparent electrodes of upper electrode patterns and black matrix patterns on an upper substrate, and depositing a predetermined metal material on the transparent electrodes of the black matrix patterns.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

A method for manufacturing a black matrix of a plasma display panel according to the present invention will be described with reference to FIGS. 3*a* to 3*c*.

Figure 1:
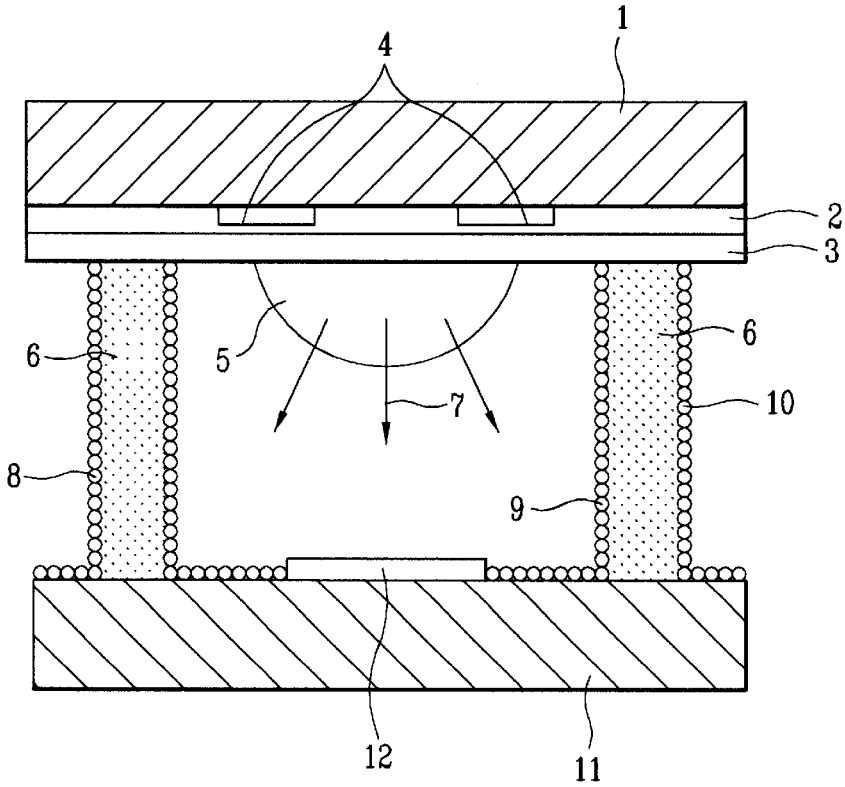
FIG. 1 Background Art
FIG. 1 is a sectional view illustrating a structure of a discharge cell of a general plasma display panel.
Figure 2:
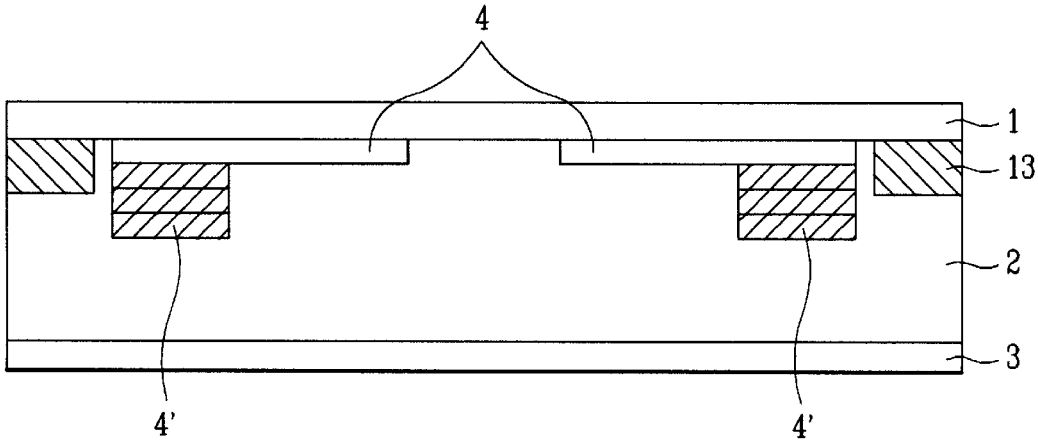
FIG. 2 Background Art
FIG. 2 is a detailed sectional view illustrating an upper substrate, an upper electrode and a black matrix of FIG. 1.
Figure 3A:
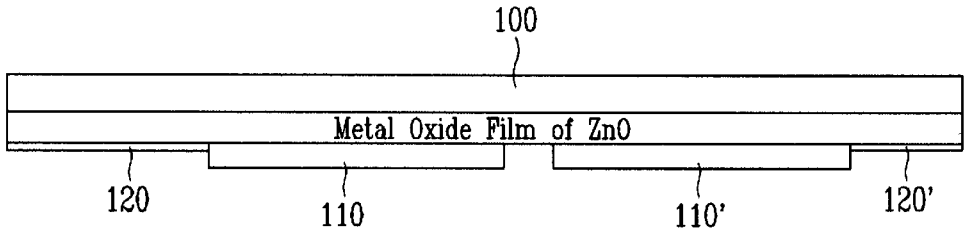
FIGS. 3*a* to 3*c* are sectional views illustrating process steps of manufacturing a plasma display panel according to the present invention.

As shown in FIG. 3*a*, transparent electrodes of upper electrode patterns 110 and 110' and black matrix patterns 120 and 120' are formed on a substrate 100 of a plasma display panel in which a metal oxide film of ZnO is formed. At this time, it is preferable that the transparent electrodes of the upper electrode patterns 110 and 110' and the black matrix patterns 120 and 120' are formed at the same time using one mask.

Figure 3B:
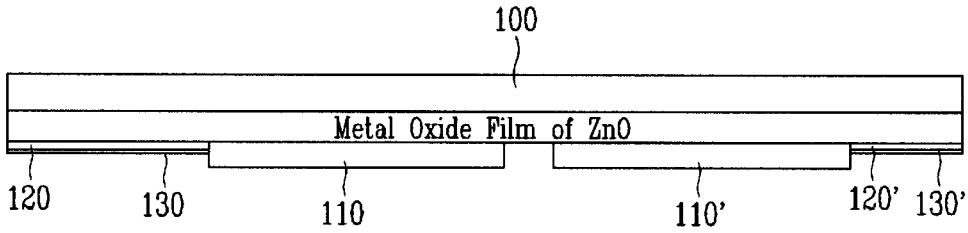

Afterwards, as shown in FIG. 3*b*, the substrate 100 on which the transparent electrodes are formed is chemical-plated to form thin metal films 130 and 130' on the transparent electrodes of the black matrix patterns 120 and 120'. Desirably, the metal films 130 and 130' are formed until the transparent electrodes become opaque in black color.

The present invention is characterized in that the metal films 130 and 130' on the transparent electrodes have thin thickness as far as possible. The thickness of the metal films 130 and 130' should be thin within the range that conductive property of the metal films 130 and 130' does not affect the discharge cell of the plasma display panel.

To form such thin films 130 and 130', catalytic process of chemical plating is required. The catalytic process is performed by exposing the surface of the transparent electrodes to $PdCl_2$ solution of pH 2.5 for 5 to 10 minutes. Thus, the exposed surface of the transparent electrodes is finely etched. The catalytic process may be performed either in both the transparent electrodes of the black matrix patterns and the transparent electrodes of the upper electrode patterns, or in only the transparent electrodes of the black matrix patterns.

If the surface of the transparent electrodes is catalyzed, the transparent electrodes of black matrix patterns 120 and 120' on the substrate 100 are exposed to $CuSO_4$ solution for several seconds or several tens of seconds to perform chemical plating. Cu is plated on the transparent electrodes by chemical plating. Then, a thin irregular reflection film of metal is formed in a portion where the surface of the transparent electrodes is etched. As a result, blackening occurs on the surface of the plated transparent electrodes, so that the transparent electrodes become opaque. In the present invention, the transparent electrode portion of the thin metal film in which blackening occurs is used as a black matrix.

Figure 3C:
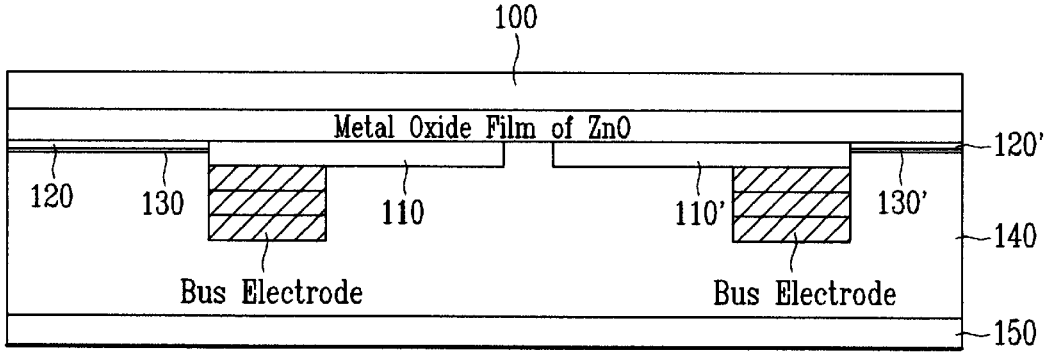

Subsequently, as shown in FIG. 3*c*, bus electrodes of metal are formed on the upper electrodes 110 and 110', and a dielectric 140 and a passivation film 150 are sequentially formed. Then, the upper substrate of the plasma display panel according to the present invention is completed.

Meanwhile, in the present invention, the black matrix may be formed by directly depositing a metal material on the metal oxide without the transparent electrode. Such a method for manufacturing a black matrix of a plasma display panel will now be described.

First, a metal oxide film of ZnO is formed on the substrate. Afterwards, the substrate on which the metal oxide film is formed is chemical-plated to form thin film metal films on a part of the metal oxide film, where the black matrix pattern will be formed. Desirably, the metal films are formed until the metal oxide film become opaque in black color.

It is characterized in that the metal films on the metal oxide film have thin thickness as far as possible. The thickness of the metal films should be thin within the range that conductive property of the metal films does not affect the discharge cell of the plasma display panel.

To form such thin films, catalytic process of chemical plating is required. The catalytic process is performed by exposing the surface of the metal oxide film to $PdCl_2$ solution of pH 2.5 for 5 to 10 minutes. Thus, the exposed surface of the metal oxide film is finely etched.

If the surface of the metal oxide film is catalyzed, the metal oxide film on the substrate is exposed to $CuSO_4$ solution for several seconds or several tens of seconds to perform chemical plating. Cu is plated on the metal oxide film by chemical plating. Then, a thin irregular reflection film of metal is formed in a portion where the surface of the metal oxide film is etched. As a result, blackening occurs on the surface of the plated metal oxide film so that the metal oxide film becomes opaque. In the present invention, the thin metal film in which blackening occurs is used as a black matrix.

Subsequently, bus electrodes of metal are formed on the upper electrodes, and a dielectric and a passivation film are sequentially formed. Then, the upper substrate of the plasma display panel according to the present invention is completed.

As aforementioned, the method for manufacturing a black matrix of a plasma display panel according to the present invention has an advantage that it is possible to manufacture the black matrix without performing a separate baking process unlike the related art method for manufacturing a black matrix of a plasma display panel. In addition, since it is possible to pattern the upper electrode and the black matrix at the same time, the manufacturing process steps are simplified and the manufacturing cost is saved.

It will be apparent to those skilled in the art that various modifications and variations can be made in the method for manufacturing a black matrix of a plasma display panel according to the present invention without departing from the spirit or scope of the invention. Thus, it is intended that the present invention covers the modifications and variations of the invention provided they come within the scope of the appended claims and their equivalents.

What is claimed is:

1. A method for manufacturing a black matrix of a plasma display panel comprising:

forming transparent electrodes of upper electrode patterns and black matrix patterns on an upper substrate; and depositing a predetermined metal material on the transparent electrodes of the black matrix patterns.

2. The method for manufacturing a black matrix of a plasma display panel as claimed in claim 1, wherein the depositing of the predetermined metal material comprises chemical-plating.

3. The method for manufacturing a black matrix of a plasma display panel as claimed in claim 2, further comprising catalyzing a surface of the transparent electrodes of the black matrix patterns before performing the chemical plating.

4. The method for manufacturing a black matrix of a plasma display panel as claimed in claim 3, wherein the catalyzing comprises exposing the transparent electrodes of the black matrix patterns to a $PdCl_2$ solution for 5 to 10 minutes.

5. The method for manufacturing a black matrix of a plasma display panel as claimed in claim 2, wherein the chemical plating comprises exposing the transparent electrode of the black matrix patterns to a $CuSO_4$ solution for a minute or less.

6. The method for manufacturing a black matrix of a plasma display panel as claimed in claim 1, wherein the predetermined metal material is thinly deposited on the transparent electrodes of the black matrix patterns so as not to have conductive property.

7. The method for manufacturing a black matrix of a plasma display panel as claimed in claim 1, wherein the transparent electrodes of the upper electrode patterns and the black matrix patterns are formed at the same time.

8. The method for manufacturing a black matrix of a plasma display panel as claimed in claim 1, wherein the plasma display panel further comprises a lower substrate facing the upper substrate, wherein the lower substrate has an address electrode, isolation walls protruding from the lower substrate to form a plurality of cells, and a plasma gas within the plurality of cells.

9. A method for manufacturing a black matrix of a plasma display panel comprising:

forming a metal oxide film on an upper substrate; and forming transparent electrodes of upper electrode patterns and a predetermined metal material on the metal oxide film, wherein the predetermined metal material serves as the black matrix.

10. The method for manufacturing a black matrix of a plasma display panel as claimed in claim 9, wherein the forming of the predetermined metal material comprises chemical-plating.

11. The method for manufacturing a black matrix of a plasma display panel as claimed in claim 10, further comprising catalyzing a surface of the metal oxide film before performing the chemical plating.

12. The method for manufacturing a black matrix of a plasma display panel as claimed in claim 11, wherein the catalyzing comprises exposing the metal oxide film to a $PdCl_2$ solution for 5 to 10 minutes.

13. The method for manufacturing a black matrix of a plasma display panel as claimed in claim 10, wherein the chemical plating comprises exposing the surface of the metal oxide film to a $CuSO_4$ solution for a minute or less.

14. The method for manufacturing a black matrix of a plasma display panel as claimed in claim 9, wherein the predetermined metal material is thinly deposited on the metal oxide film so as not to have conductive property.

15. The method for manufacturing a black matrix of a plasma display panel as claimed in claim 9, wherein the plasma display panel further comprises a lower substrate facing the upper substrate, wherein the lower substrate has an address electrode, isolation walls protruding from the lower substrate to form a plurality of cells, and a plasma gas within the plurality of cells.

16. A method for manufacturing a black matrix of a plasma display panel comprising:

forming electrodes of black matrix patterns on an upper substrate; and blackening said electrodes of black matrix patterns.

17. The method for manufacturing a black matrix of a plasma display panel as claimed in claim 16, further comprising forming electrodes of an upper electrode pattern on the upper substrate while forming the electrodes of the black matrix patterns.

18. The method for manufacturing a black matrix of a plasma display panel as claimed in claim 16, wherein the plasma display panel further comprises a lower substrate facing the upper substrate, wherein the lower substrate has an address electrode, isolation walls protruding from the lower substrate to form a plurality of cells, and a plasma gas within the plurality of cells.

19. The method for manufacturing a black matrix of a plasma display panel as claimed in claim 16, wherein the electrodes of black matrix patterns are transparent.

20. The method for manufacturing a black matrix of a plasma display panel as claimed in claim 16, wherein said blackening of said electrodes of black matrix patterns comprises chemical plating of a metal film.

21. A method for manufacturing a black matrix of a plasma display panel comprising:

forming a metal oxide layer on an upper substrate;

forming transparent electrodes of upper electrode patterns on the metal oxide layer; and blackening portions of said metal oxide layer, wherein said blackened portions serve as the black matrix.

22. The method for manufacturing a black matrix of a plasma display panel as claimed in claim 21, wherein said blackening comprises chemical plating of a thin metal film which causes the metal oxide film to become opaque and black in color.

23. The method for manufacturing a black matrix of a plasma display panel as claimed in claim 21, wherein the plasma display panel further comprises a lower substrate facing the upper substrate, wherein the lower substrate has an address electrode, isolation walls protruding from the lower substrate to form a plurality of cells, and a plasma gas within the plurality of cells.

24. The method for manufacturing a black matrix of a plasma display panel as claimed in claim 23, wherein the catalyzing comprises exposing the metal oxide film to a $PdCl_2$ solution for 5 to 10 minutes.

25. The method for manufacturing a black matrix of a plasma display panel as claimed in claim 23, wherein the chemical plating comprises exposing the surface of the metal oxide layer to a $CuSO_4$ solution for a minute or less.

26. The method for manufacturing a black matrix of a plasma display panel as claimed in claim 21, further comprising:

catalyzing a surface of the metal oxide layer before said blackening of the metal oxide layer; and chemical plating the metal oxide layer to cause said blackening of the metal oxide layer.

* * * * *